US011377177B2

(12) United States Patent
Araki et al.

(10) Patent No.: US 11,377,177 B2
(45) Date of Patent: Jul. 5, 2022

(54) PERSONAL WATERCRAFT

(71) Applicant: KAWASAKI MOTORS, LTD., Akashi (JP)

(72) Inventors: Toshio Araki, Akashi (JP); Yu Shibuta, Kobe (JP); Atsuko Arai, Himeji (JP)

(73) Assignee: KAWASAKI MOTORS, LTD., Akashi (JP)

( * ) Notice: Subject to any disclaimer, the term of this patent is extended or adjusted under 35 U.S.C. 154(b) by 0 days.

(21) Appl. No.: 17/062,257

(22) Filed: Oct. 2, 2020

(65) Prior Publication Data

US 2022/0106022 A1 Apr. 7, 2022

(51) Int. Cl.

| | |
|---|---|
| ***B63B 34/10*** | (2020.01) |
| ***B63B 11/02*** | (2006.01) |
| ***B63B 3/68*** | (2006.01) |
| ***B63H 11/04*** | (2006.01) |
| ***B63B 3/48*** | (2006.01) |
| ***B63B 21/22*** | (2006.01) |

(52) U.S. Cl.

CPC ..... *B63B 34/10* (2020.02); *B63B 3/48* (2013.01); *B63B 3/68* (2013.01); *B63B 11/02* (2013.01); *B63B 21/22* (2013.01); *B63H 11/04* (2013.01)

(58) Field of Classification Search

CPC .. B63B 34/10; B63B 3/48; B63B 3/68; B63B 11/02; B63B 21/22; B63H 111/04

See application file for complete search history.

(56) References Cited

U.S. PATENT DOCUMENTS

| | | | | |
|---|---|---|---|---|
| 10,065,721 | B1 * | 9/2018 | Girard | B63H 11/04 |
| 10,227,110 | B1 * | 3/2019 | Valence | B63H 11/04 |
| 2009/0158982 | A1 * | 6/2009 | Ross | B63B 25/002 114/55.57 |
| 2018/0346075 | A1 * | 12/2018 | Morgan | B63B 34/67 |
| 2019/0299872 | A1 * | 10/2019 | Pratka | B60P 7/135 |

FOREIGN PATENT DOCUMENTS

WO WO-2013149028 A1 * 10/2013 ..... B60P 7/0807

* cited by examiner

*Primary Examiner* — S. Joseph Morano
*Assistant Examiner* — Jovon E Hayes
(74) *Attorney, Agent, or Firm* — Alleman Hall Creasman & Tuttle LLP

(57) ABSTRACT

A personal watercraft includes: a watercraft body including a cargo-carrying surface; and at least one anchor rail mounted on the watercraft body, the anchor rail being adjacent to the cargo-carrying surface and exposed to an environment outside the watercraft body.

19 Claims, 11 Drawing Sheets

PERSONAL WATERCRAFT

BACKGROUND

Technical Field

An aspect of the present disclosure relates to a personal watercraft.

Description of the Related Art

U.S. Pat. No. 10,227,110 B1 discloses a personal watercraft provided with a relatively wide cargo-carrying surface located rearward of a seat on which a user sits. On the cargo-carrying surface of the personal watercraft is mounted an anchor fixture of the pop-up type used to hold a cargo placed on the cargo-carrying surface. The size, shape, and placement position of the cargo can vary from user to user. Thus, a cargo-holding mechanism adaptable to various forms of cargoes is desired.

SUMMARY

A personal watercraft according to an aspect of the present disclosure includes: a watercraft body including a cargo-carrying surface; and at least one anchor rail mounted on the watercraft body, the anchor rail being adjacent to the cargo-carrying surface and exposed to an environment outside the watercraft body.

This configuration can increase the variety of sizes, shapes, and placement positions of cargoes placeable on the cargo-carrying surface of the watercraft body, thus providing improved user-friendliness.

DETAILED DESCRIPTION OF THE EMBODIMENTS

Hereinafter, exemplary embodiments will be described with reference to the drawings.

Figure 1:
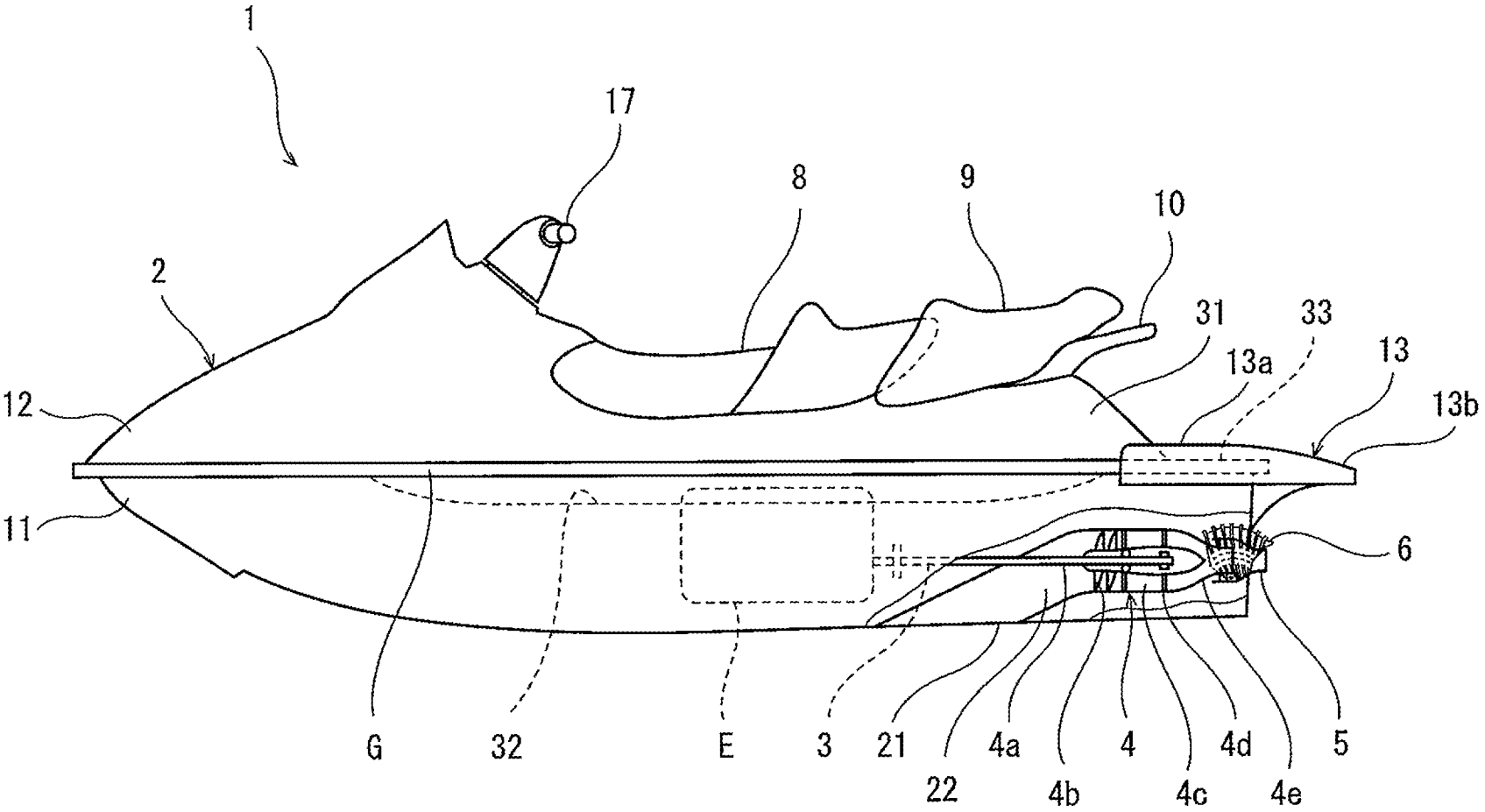
FIG. 1 is a left side view of a personal watercraft according to an exemplary embodiment.

FIG. 1 is a left side view of a personal watercraft 1 according to an exemplary embodiment. Referring to FIG. 1, the personal watercraft 1 (hereinafter referred to as "PWC") includes a watercraft body 2 made of resin. The watercraft body 2 includes a hull 11, a base deck 12, and an additional deck 13. The hull 11 forms the bottom surface of the watercraft body 2. The base deck 12 covers the hull 11 from above and is secured to the hull 11. In the watercraft body 2, the portion where the hull 11 and the base deck 12 are connected is referred to as a "gunwale line G". The additional deck 13 is mounted as an additional component on the rears of the hull 11 and the base deck 12. On the additional deck 13 is mounted an anchor rail 15 for carrying a cargo Y. The anchor rail 15 will be described later.

The interior of the watercraft body 2 includes an engine room, in which an engine E serving as a prime mover is accommodated. The engine E includes an output shaft connected to a propeller shaft 3 extending rearward. The rear end of the propeller shaft 3 is connected to a pump shaft 4*a* of a water jet pump 4 located in the rear of the hull 11. An impeller 4*b* is mounted on the pump shaft 4*a*. A stator vane 4*c* is located rearward of the impeller 4*b*. A pump casing 4*d* is located radially outward of the impeller 4*b* and encloses the impeller 4*b*.

A water inlet 21 opens at the bottom of the hull 11. The water inlet 21 is in communication with the pump casing 4*d* via a water passage 22. The pump casing 4*d* is provided with a pump nozzle 4*e* facing rearward of the watercraft body 2. The pump nozzle 4*e* decreases in diameter from front to rear, and an ejection orifice opens at the rear end of the pump nozzle 4*e*. To the pump nozzle 4*e* is connected a steering nozzle 5 which is swingable in the left-right direction. A bowl-shaped reverse bucket 6 is located in proximity to the steering nozzle 5. The reverse bucket 6 is pivotally supported by the hull 11 and pivotable between an advanced position where the reverse bucket 6 covers the ejection orifice of the steering nozzle 5 from behind to cause water ejected from the pump nozzle 4*e* to be redirected forward and a retracted position where the reverse bucket 6 allows the ejection orifice of the steering nozzle 5 to be open in the rearward direction.

In the PWC 1, water drawn into the hull 11 through the water inlet 21 located at the bottom of the hull 11 is pressurized and accelerated by rotational power of the impeller 4*b* of the water jet pump 4 driven by the engine E. The flow of water is conditioned by the stator vane 4 and ejected rearward through the ejection orifice of the pump nozzle 4*e* and the steering nozzle 5 to produce propulsion power. A bar-shaped handle 7 is located above the front of the base deck 12 and rotatably supported by the base deck 12. When the operator tilts the handle 7 to the left or right, the steering nozzle 5 swings to the left or right in conjunction with the tilting movement of the handle 7.

The base deck 12 includes a seat support 31, a pair of foot rest surfaces 32, and a rear deck surface 33. The seat support 31 is located rearward of the handle 7 and projects upward from the deck floor. The foot rest surfaces 32 are located to the left and right, respectively, of the seat support 31 on the deck 12 and extend in the front-rear direction. The foot rest surfaces 32 constitute a part of the deck floor. The seat support 31 supports a front seat 8 and a rear seat 9 from below. The front and rear seats 8 and 9 are straddle seats on which users sit in a straddling position. The number of the seats supported by the seat support 31 is not limited to two. One seat or three seats may be supported by the seat support 31.

The rear deck surface 33 is located rearward of the seat support 31 and faces upward. Without the additional deck 13, the rear deck surface 33 would constitute a part of the deck floor. The rear deck surface 33 is a rear region of the upper surface of the base deck 12. The additional deck 13 is removably secured to the hull 11 and the base deck 12 to cover a rear portion of the gunwale line G and the rear deck surface 33 of the base deck 12. The additional deck 13 projects rearward beyond the hull 11 and the base deck 12.

Figure 2:
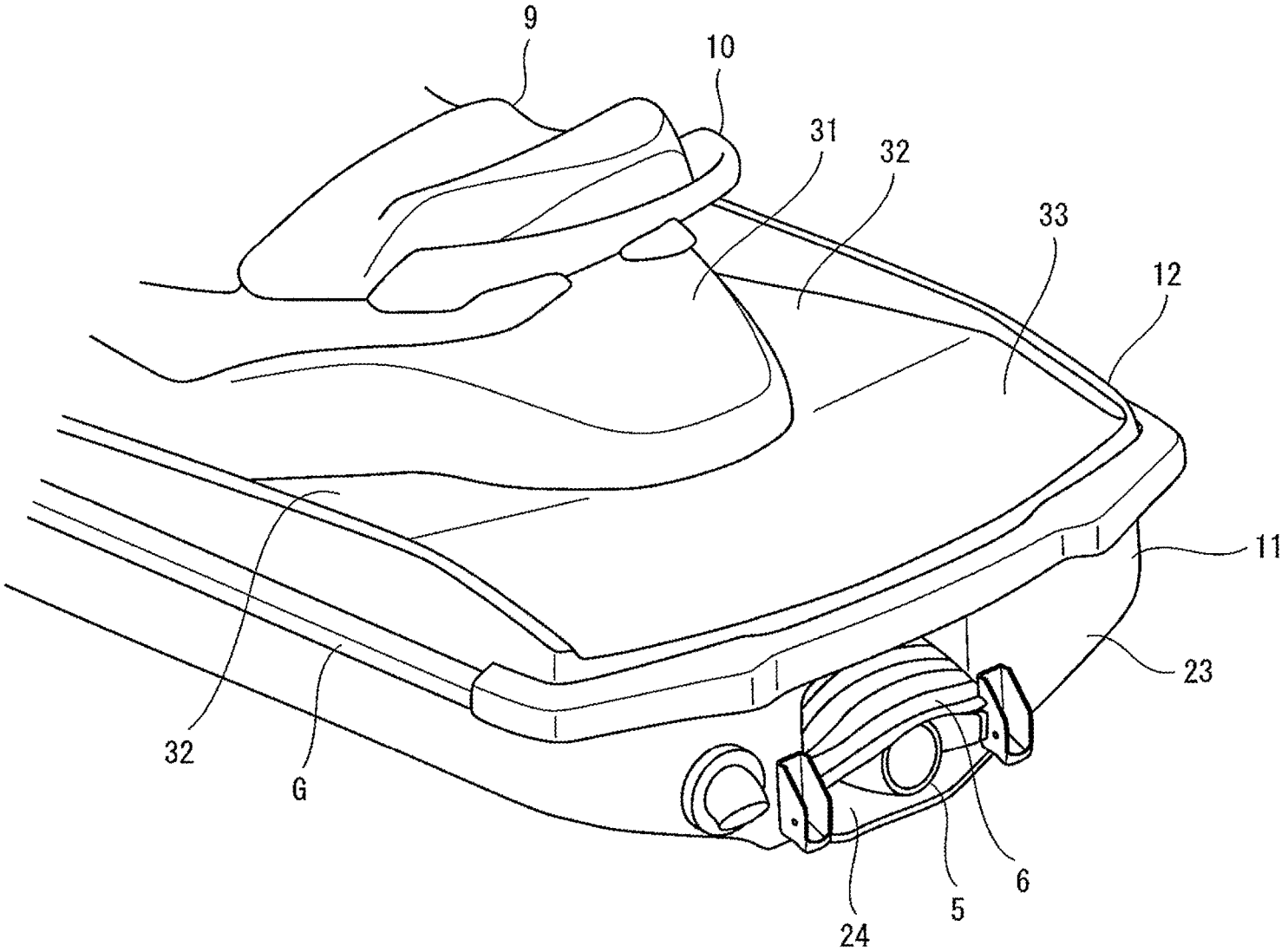
FIG. 2 is a top left perspective view of the rear of the personal watercraft of FIG. 1 with an additional deck removed.

FIG. 2 is a top left perspective view of the rear of the PWC 1 of FIG. 1 with the additional deck 13 removed. In the deck floor of the base deck 12, as seen from FIG. 2, the foot rest surfaces 32 are continuous with the rear deck surface 33. The boundary portion between the pair of foot rest surfaces 32 and the rear deck surface 33 bulges upward. If the additional deck 13 is not provided, the watercraft body could be constructed of the hull 11 and the base deck 12. The hull 11 includes a back surface 23 facing rearward. The back surface 23 is provided with a pump opening 24 through which the water jet pump 4 (see FIG. 1) is exposed to the environment behind the PWC 1. The steering nozzle 5 and the reverse bucket 6 are disposed inside the pump opening 24.

Figure 3:
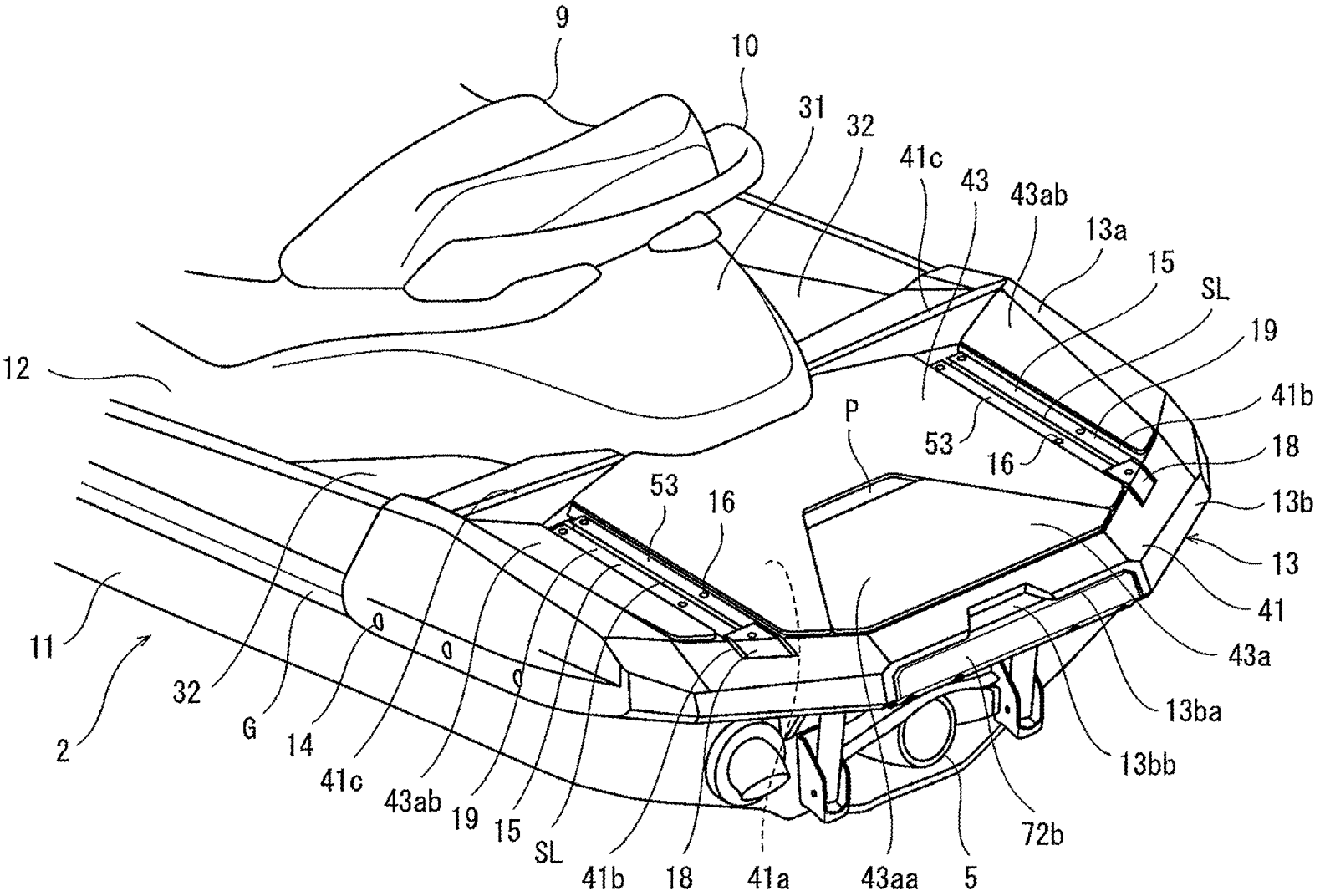
FIG. 3 is a top left perspective view of the rear of the personal watercraft of FIG. 1.
Figure 4:
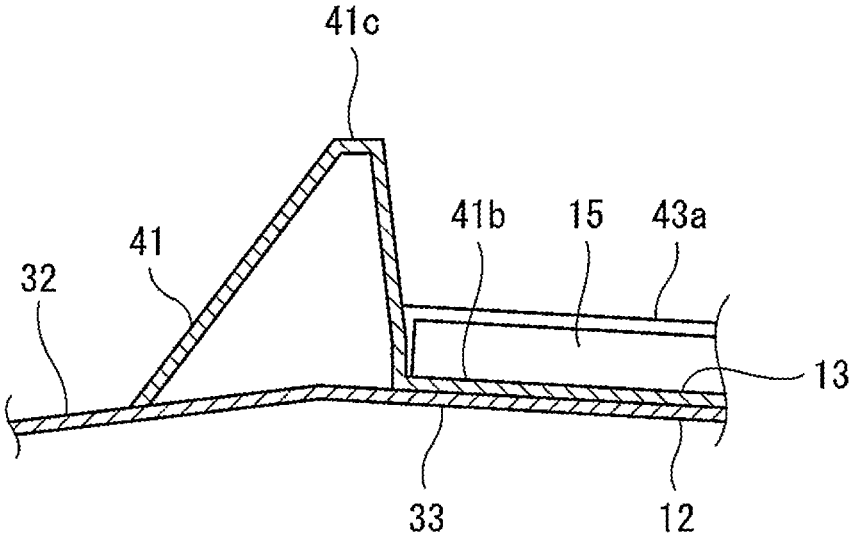
FIG. 4 is a side cross-sectional view of a partition shown in FIG. 3 and its vicinity.
Figure 5:
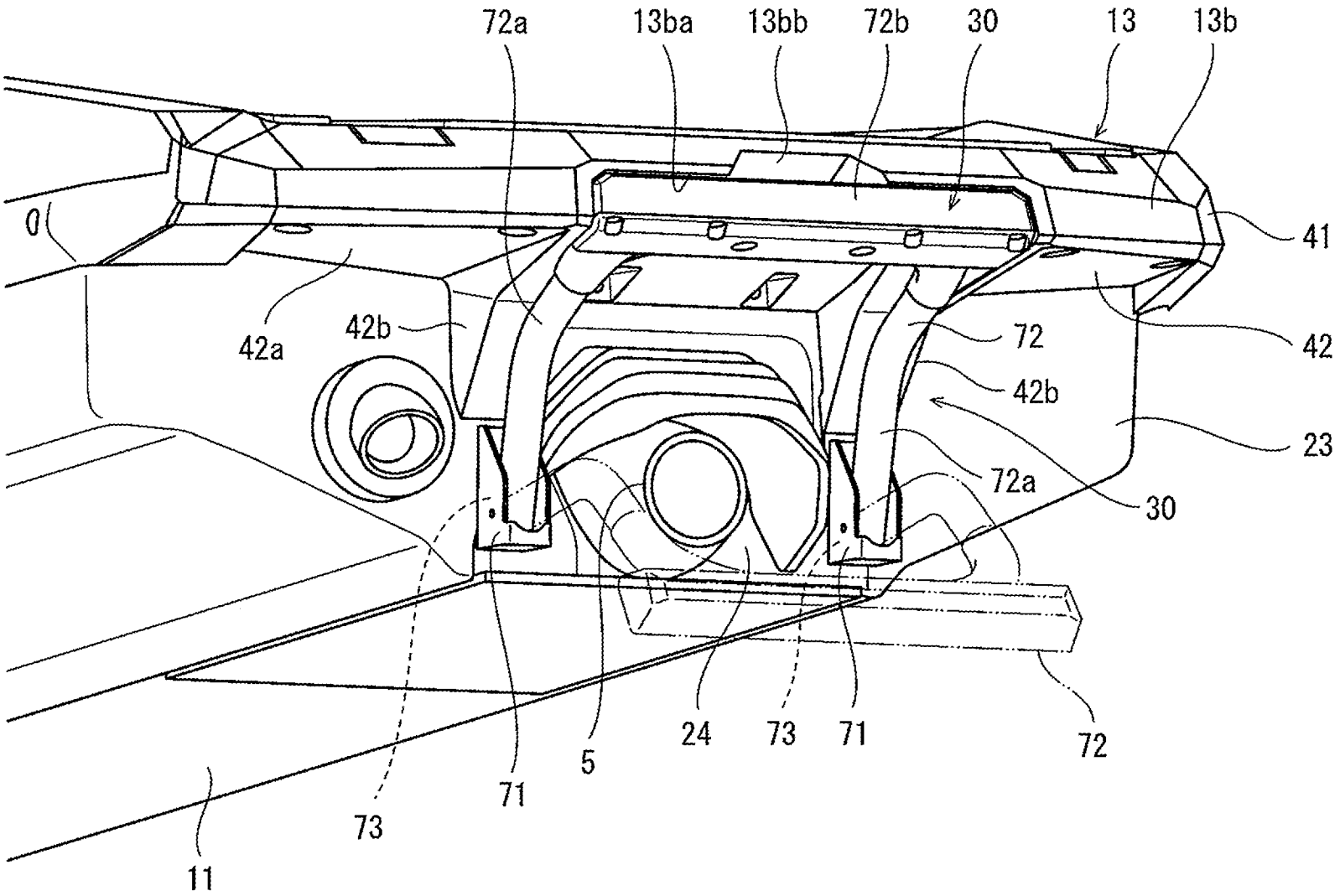
FIG. 5 is a bottom left perspective view of the personal watercraft's rear of FIG. 2.

FIG. 3 is a perspective view of the rear of the PWC 1 of FIG. 1. FIG. 4 is a side cross-sectional view of a partition 41*c* shown in FIG. 3 and its vicinity. FIG. 5 is a bottom left perspective view of the PWC 1's rear of FIG. 2. Referring to FIGS. 3 and 5, the additional deck 13 includes a covering portion 13*a* and a projecting portion 13*b* continuous with the covering portion 13*a* and projecting rearward from the covering portion 13*a*. The covering portion 13*a* is located forward of the rear end of the base deck 12 and covers the rear deck surface 33 of the base deck 12. The projecting portion 13*b* projects rearward beyond the rear end of the base deck 12.

The additional deck 13 covering the rear portion of the gunwale line G is secured to the lateral sides of the rear portion of the gunwale line G by side fasteners 14 (e.g., bolts). The side fasteners 14 fasten the additional deck 13, base deck 12, and hull 11 together. The additional deck 13 includes an upper panel 41, a lower panel 42, and a covering sheet 43.

The upper panel 41 covers the rear deck surface 33 (see FIG. 2) of the base deck 12 from above and has a projecting portion extending rearward beyond the back surface 23 of the hull 11. The lower panel 42 covers the projecting portion of the upper panel 41 from below. The lower panel 42 is secured to the lower side of the upper panel 41. The upper panel 41 covers the rear portion of the gunwale line G from above, and the lower panel 42 covers the rear portion of the gunwale line G from below.

The covering sheet 43 covers the upper surface 41*a* of the upper panel 41 and is adhered to the upper panel 41. The covering sheet 43 is made of, for example, a material softer than the material of the upper panel 41. The surface roughness of the covering sheet 43 is greater than the surface roughness of the upper panel 41. The covering sheet 43 may cover all or a part of the upper surface 41*a* of the upper panel 41. The covering sheet 43 is composed of a plurality of covering sheets adhered individually to the upper surface 41*a* of the upper panel 41. Alternatively, the covering sheet may be a single, continuous sheet.

The upper surface of the covering sheet 43 is a cargo-carrying surface 43*a* on which cargoes are placeable. The cargo-carrying surface 43*a* is located rearward of the rear seat 9 (in particular, rearward of the seat support 31) and faces upward. With the additional deck 13 mounted on the watercraft body 2, the cargo-carrying surface 43*a* constitutes a part of the deck floor of the watercraft body 2.

Referring to FIG. 3, the upper panel 41 of the additional deck 13 includes the upper surface 41*a*, a pair of receiving grooves 41*b*, and a pair of partitions 41*c*. The upper surface 41*a* of the upper panel 41 is located rearward of the rear seat 9 (in particular, rearward of the seat support 31) and faces upward. The receiving grooves 41*b* are recessed downward from the upper surface 41*a* of the upper panel 41 and extend in the front-rear direction. The two receiving grooves 41*b* are spaced apart from each other in the left-right direction. The two receiving grooves 41*b* are symmetrical with respect to a center line extending in the front-rear direction through the center of the watercraft body 2 in the left-right direction.

The two receiving grooves 41*b* receive the two anchor rails 15, respectively. Thus, the two anchor rails 15 are located rearward of the seat support 31, spaced apart from each other in the left-right direction, and extend in the front-rear direction. The two anchor rails 15 are substantially parallel to each other. Imaginary forward extensions of the anchor rails 15 overlap the foot rest surfaces 32 in plan view.

The anchor rails 15 are adjacent to the cargo-carrying surface 43*a* of the additional deck 13 and exposed to the environment outside the watercraft body 2. Each anchor rail 15 includes: a receiving plate 53 exposed to the environment outside (above) the watercraft body 2; and a slit SL formed in the receiving plate 53 and extending in the longitudinal direction of the anchor rail 15. The details of the structure of the anchor rails 15 will be described later. Each anchor rail 15 is secured to the watercraft body 2 in such a manner that its outwardly facing surface exposed to the environment outside the watercraft body 2 (namely, the upper surface of the receiving plate 53) is recessed downward relative to the cargo-carrying surface 43*a* to form a recess 19. The cargo-carrying surface 43*a* includes a central surface 43*aa* located between the two anchor rails 15 and outer edge surfaces 43*ab* located outward of the anchor rails 15 in the left-right direction.

In side view, the central surface 43*aa* of the cargo-carrying surface 43*a* is inclined with respect to the horizontal plane so as to extend rearward and downward. Further, in rear view, the central surface 43*aa* of the cargo-carrying surface 43*a* is inclined with respect to the horizontal plane so as to extend downward and outward in the left-right direction toward the anchor rails 15. Thus, in rear view, the central surface 43*aa* of the cargo-carrying surface 43*a* is in the shape of an upwardly convex arch. The outer edge surfaces 43*ab* of the cargo-carrying surface 43*a* are inclined with respect to the horizontal plane so as to extend downward and inward in the left-right direction toward the anchor rails 15.

The additional deck 13 includes a recess P located in the central surface 43*aa* and opening upward. Specifically, the upper panel 41 is provided with a recess, and the covering sheet 43 is provided with an opening allowing the recess to open upward. The recess P is in an elongated shape extending longitudinally in the left-right direction. The recess P is configured to allow the user to put his/her hand into the recess P when getting onto the watercraft from the water.

The longitudinal length of the receiving grooves 41*b* is greater than the longitudinal length of the anchor rails 15. The rear ends of the receiving grooves 41*b* are open in the rearward direction. The rear ends of the anchor rails 15 are located closer to the center of the watercraft body than (namely, located forward of) the rear ends of the receiving grooves 41*b* in the longitudinal direction of the receiving groove 41*b*. A filler 18 is placed in the rear end portion of each receiving groove 41*b* to cover the rear end of the anchor rail 15. The filler 18 is a resin molded product. The filler 18 is removably secured to the additional deck 13 by a fastener.

Referring to FIGS. 3 and 4, the partitions 41*c* of the upper panel 41 are located between the cargo-carrying surface 43*a* and the foot rest surfaces 32. Each partition 41*c* includes a back surface facing rearward. Imaginary forward extensions of the anchor rails 15 intersect the partitions 41*c* in plan view. The partitions 41*c* project upward with respect to the foot rest surfaces 32 and the cargo-carrying surface 43*a*, and project upward with respect to the front edges of the upper surfaces of the anchor rails 15.

Referring to FIG. 5, the lower panel 42 includes: a lower surface 42*a* located above the pump opening 24 of the back surface 23 of the hull 11; and a pair of gussets 42*b* projecting downward from the lower surface 42*a*. The two gussets 42*b* are located to the left and right, respectively, of the pump opening 24, and are in contact with and secured to the back surface 23 of the hull 11. Thus, the gussets 42*b* serve as a reinforcing structure supporting the projecting portion 13*b* of the additional deck 13 from below.

Figure 6:
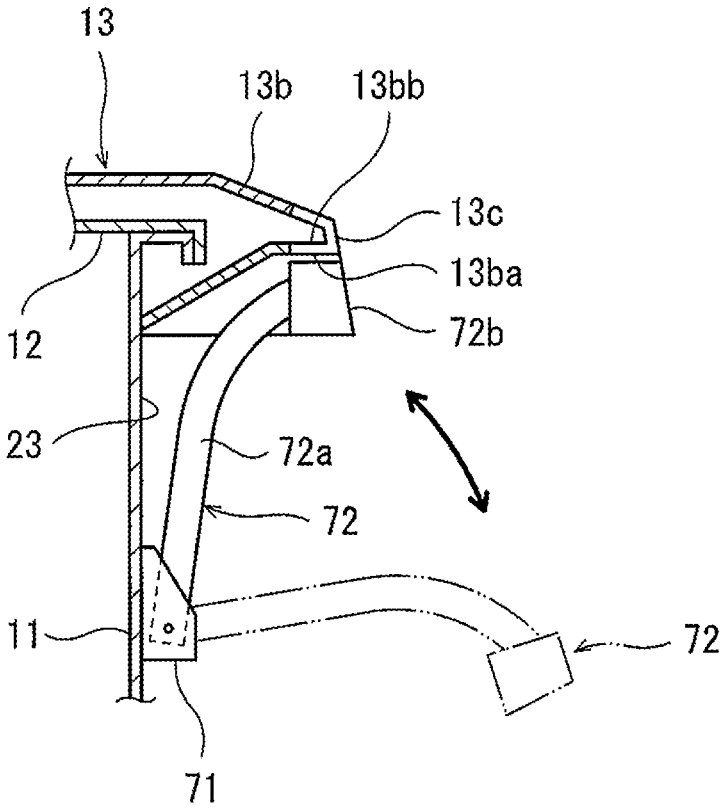
FIG. 6 is a side cross-sectional view of a movable step mechanism shown in FIG. 5 and its vicinity.

FIG. 6 is a side cross-sectional view of a movable step mechanism 30 shown in FIG. 5 and its vicinity. As seen from FIGS. 5 and 6, the movable step mechanism 30 is mounted on the hull 11. The movable step mechanism 30 includes a pair of brackets 71, a movable step 72, and a pair of return springs 73. The two brackets 71 are located to the left and right, respectively, of the pump opening 24, and secured to the back surface 23 of the hull 11. The movable step 72 is pivotally supported by the pair of brackets 71 and pivotable about an axis extending in the left-right direction.

Specifically, the movable step 72 includes a pair of supporting arms 72*a* pivotally supported respectively by the pair of brackets 71 and a step bar 72*b* connected to the distal ends of the supporting arms 72*a* and extending in the left-right direction. The movable step 72 is configured to pivot between a retracted position (indicated by a solid line in FIG. 5) and a use position (indicated by a dashed-two dotted line in FIG. 5). The return springs 73 bias the movable step 72 toward the retracted position. The step bar 72*b* of the movable step 72 is located at a lower level when the movable step 72 is in the use position than when the movable step 72 is in the retracted position. The step bar 72*b* placed in the retracted position is lowered by the user against the return springs 73, and thus the step bar 72*b* is moved to the use position.

The rear end portion of the projecting portion 13*b* of the additional deck 13 includes a receiving recess 13*ba* opening rearward and downward. When the movable step 72 is in the retracted position, the step bar 72*b* is placed in the receiving recess 13*ba*. The back surface of the step bar 72*b* placed in the retracted position is flush with the adjacent back surface of the additional deck 13. The rear end portion of the projecting portion 13*b* of the additional deck 13 includes a cut 13*bb* extending upward from the receiving recess 13*ba* and opening at least rearward. The length of the cut 13*bb* in the left-right direction is smaller than the length of the receiving recess 13*ba* in the left-right direction. The user can put his/her hand into the cut 13*bb* and touch the upper surface of the step bar 72*b* to manually lower the movable step 72 from the retracted position to the use position.

Figure 7:
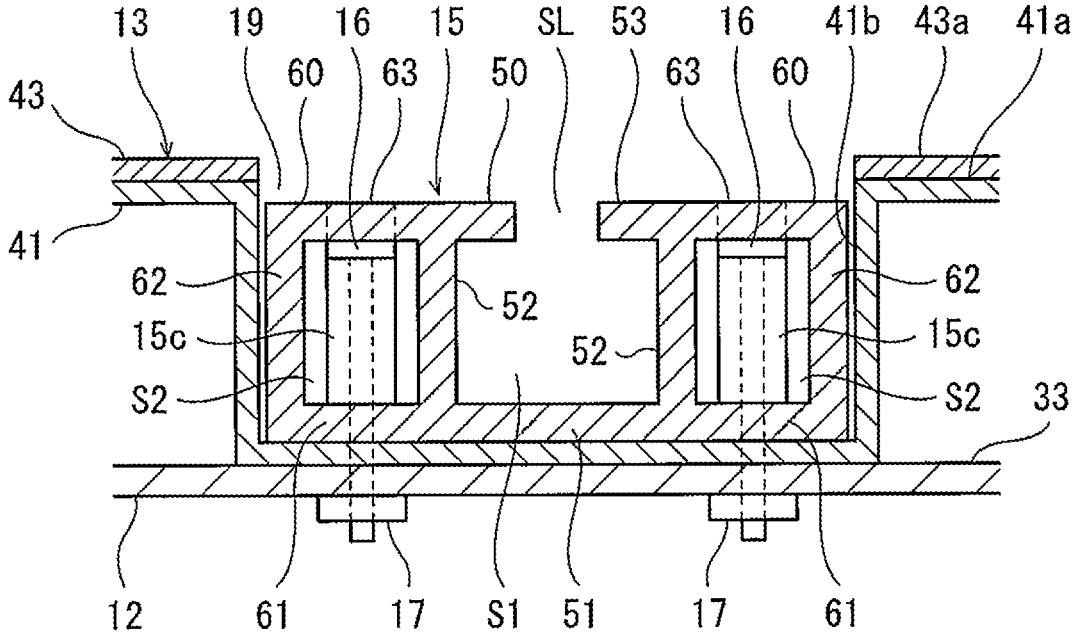
FIG. 7 is a rear cross-sectional view of an anchor rail shown in FIG. 2 and its vicinity.

FIG. 7 is a rear cross-sectional view of the anchor rail 15 shown in FIG. 2 and its vicinity. Referring to FIG. 7, the anchor rail 15 includes a rail main portion 50 and a pair of reinforcing portions 60 adjacent to both sides of the rail main portion 50. The rail main portion 50 includes a bottom plate 51, a pair of side plates 52, and a receiving plate 53. The bottom plate 51 is mounted on the bottom surface of the receiving groove 41*b* of the additional deck 13. The two side plates 52 project upward from both lateral edges of the bottom plate 51. The receiving plate 53 is located above and away from the bottom plate 51. The receiving plate 53 is positioned parallel to the bottom plate 51 and connected to the upper edges of the side plates 52.

The upper surface of the receiving plate 53 is an outwardly facing surface exposed to the environment outside the watercraft body. The receiving plate 53 is provided with the slit SL extending in the longitudinal direction of the anchor rail 15. The slit SL extends over the entire length of the anchor rail 15 in the longitudinal direction. The slit SL may extend over a part of the anchor rail 15 in the longitudinal direction. The bottom plate 51, side plates 52, and receiving plate 53 define an anchor space S1 extending in the longitudinal direction of the anchor rail 15. The anchor space S1, which is an inner space of the rail main portion 50, is in communication with the environment outside the rail main portion 50 (outside the watercraft body) through the slit SL.

Each reinforcing portion 60 includes a bottom plate 61, a side plate 62, and an upper plate 63. The bottom plate 61 is mounted on the bottom surface of the receiving groove 41*b* of the additional deck 13. The bottom plate 61 is located adjacent to and in the same plane as the bottom plate 51 and is connected to the bottom plate 51. The side plate 62 projects upward from the outer lateral edge of the bottom plate 61. The upper plate 63 is located above and away from the bottom plate 61. The upper plate 63 is positioned parallel to the bottom plate 61, and the upper edge of the side plate 62 is connected to the upper plate 63. The bottom plate 61, side plate 62, upper plate 63, and side plate 52 form a closed cross-section. That is, the reinforcing portion 60 defines an inner reinforcement space S2.

The upper surface of the upper plate 63 is an outwardly facing surface lying side-by-side with the slit SL and exposed to the environment outside the watercraft body 2. The reinforcing portion 60 is located outward of the rail main portion 50 in the width direction of the slit SL (the left-right direction) and connected to a side surface of the rail main portion 50. The anchor rail 15 is secured to the additional deck 13 in such a manner that the outwardly facing surfaces of the anchor rail 15 (the upper surfaces of the rail main portion 50 and reinforcing portions 60) are recessed downward relative to the cargo-carrying surface 43*a* to form the recess 19. The height of the anchor rail 15 is smaller than the depth of the receiving groove 41*b*. The upper surface of the anchor rail 15 is located at a lower level than the cargo-carrying surface 43*a*. Alternatively, the anchor rail 15 may be secured to the additional deck 13 in such a manner that the outwardly facing surfaces are flush with the adjacent cargo-carrying surface 43*a*. That is, the anchor rail 15 is placed so as not to project upward from the adjacent cargo-carrying surface 43*a*.

Figure 8:
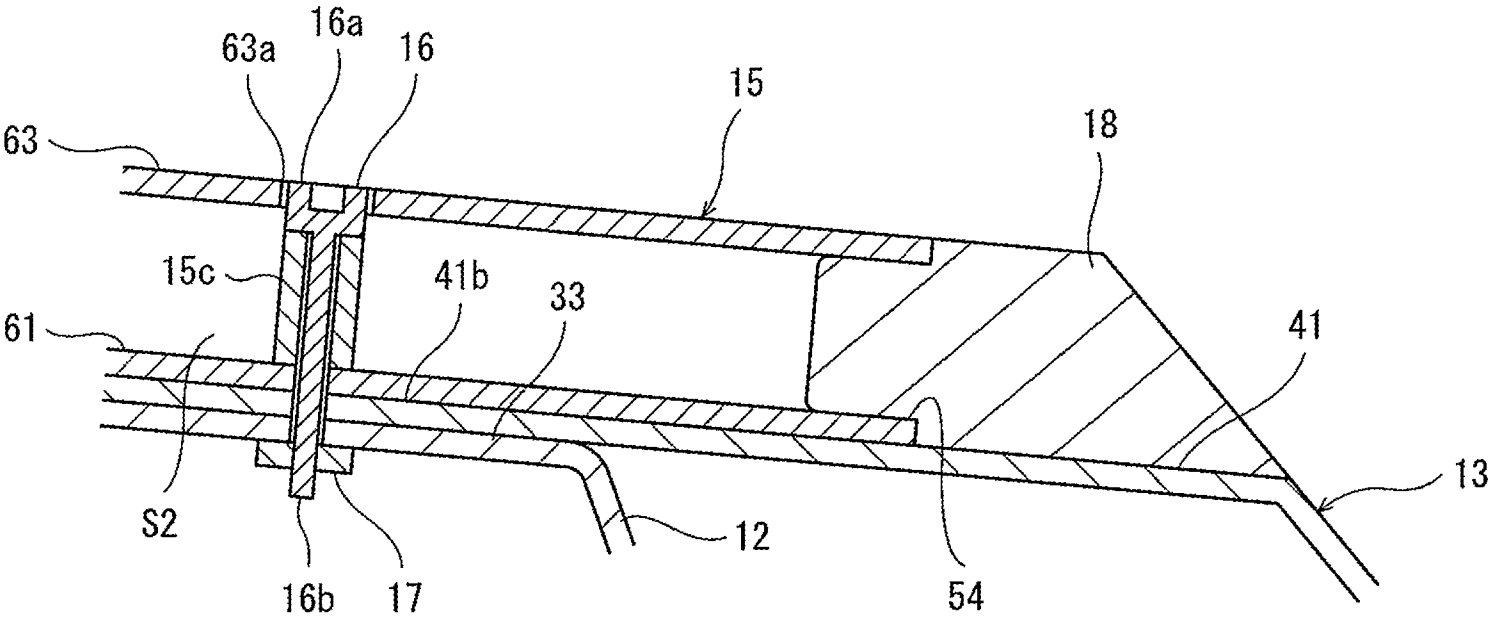
FIG. 8 is a left side cross-sectional view of the anchor rail shown in FIG. 2 and its vicinity.

FIG. 8 is a left side cross-sectional view of the anchor rail 15 shown in FIG. 2 and its vicinity. As seen from FIGS. 7 and 8, the lower surface of the bottom wall of the receiving groove 41*b* of the additional deck 13 is located above and in contact with the rear deck surface 33 of the base deck 12. The lower surface of the anchor rail 15 is in contact with the upper surface of the bottom wall of the receiving groove 41*b* of the additional deck 13. Nuts 17 are secured to that portion of the lower surface of the base deck 12 which is associated with the receiving groove 41*b*. A plurality of upper fasteners 16 (e.g., bolts) are threaded into the nuts 17 to fasten the anchor rail 15, the additional deck 13, and the base deck 12 together at the bottom wall of the receiving groove 41*b*.

Referring to FIG. 8, each upper fastener 16 includes a shaft portion 16*a* and a head portion 16*b* located at the upper end of the shaft portion 16*a*. Holes 63*a* are formed at predetermined locations on the upper plate 63 (see FIG. 7) of each reinforcing portion 60 of the anchor rail 15. Each hole 63*a* has a size which allows the shaft and head portions 16*a* and 16*b* of the upper fastener 16 to pass through the hole 63*a*. The anchor rail 15 includes collars 15*c* located in the reinforcement spaces S2. Each collar 15*c* is held between the head portion 16*b* of the upper fastener 16 and the bottom plate 61 of the reinforcing portion 60. The presence of the collar 15*c* allows the head portion 16*b* of the upper fastener 16 to be positioned close to the hole 63*a* of the upper plate 63. The collar 15*c* has a length such that the upper surface of the head portion 16*b* of the upper fastener 16 does not project upward from the upper surface of the anchor rail 15.

When the PWC 1 is at rest on the water, the anchor rail 15 is inclined to extend rearward and downward. The rear end of the anchor rail 15 is located forward of (closer to the center of the watercraft body than) the rear end of the receiving groove 41*b*. The anchor rail 15 has a rear end opening 54 that allows the inner spaces of the anchor rail 15 to open in the rearward direction. The filler 18 is placed in the receiving groove 41*b* to close a rear end opening 54 of the anchor rail 15. The filler 18 placed in the receiving groove 41*b* and secured to the additional deck 13 is preferably flush with the adjacent outer surface of the additional deck 13. A part of the filler 18 is inserted into the rear end opening 54 of the anchor rail 15. The rear end portion of the anchor rail 15 is provided with a drain hole which allows the anchor space S1 to communicate with the environment outside the watercraft.

Figure 9:
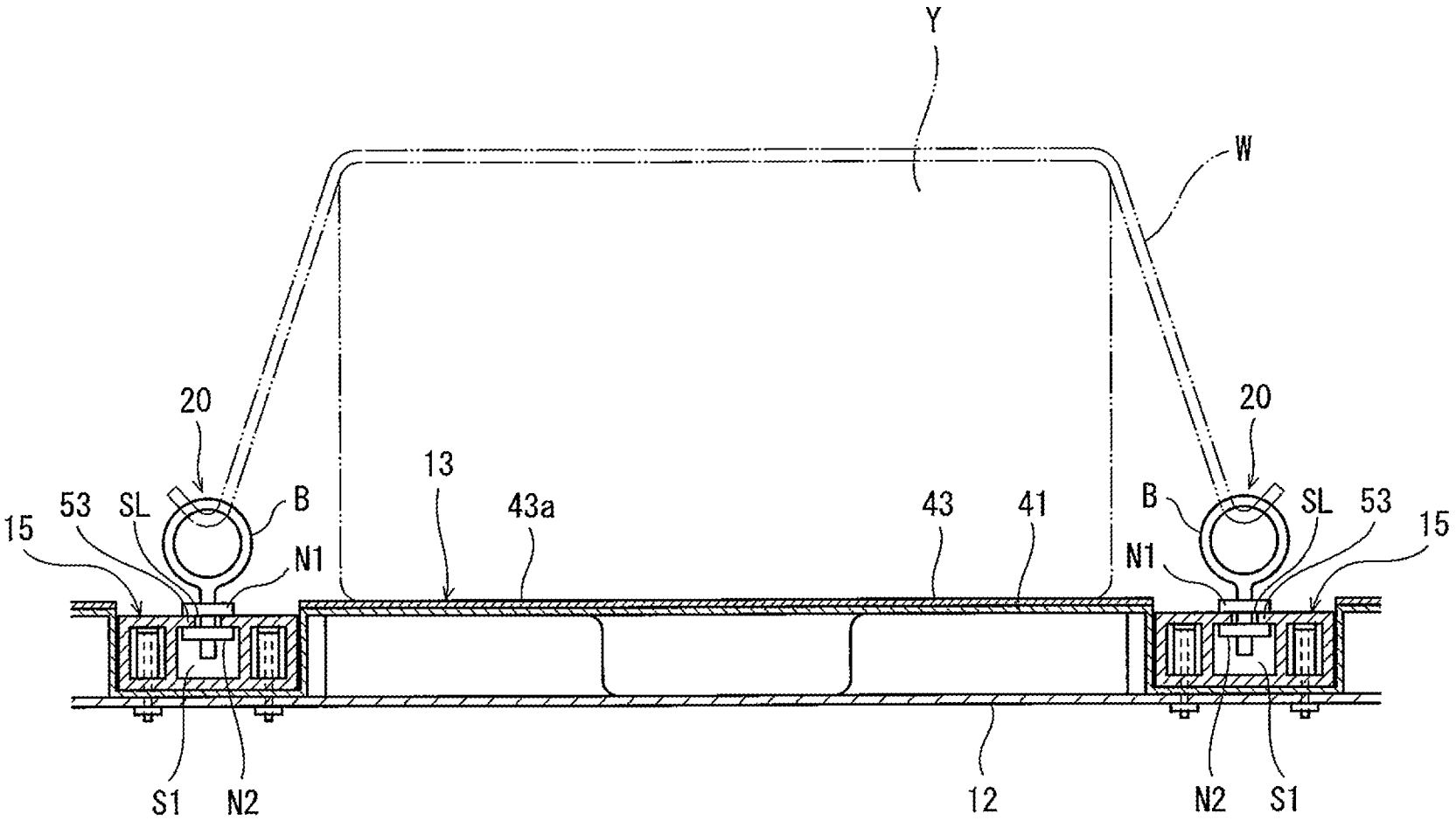
FIG. 9 is a cross-sectional view of key elements and illustrates an example of how to use the anchor rail shown in FIG. 2.

FIG. 9 is a cross-sectional view of key elements and illustrates an example of how to use the anchor rail 15 shown in FIG. 2. Referring to FIG. 9, when a cargo Y is placed on the cargo-carrying surface 43*a* of the additional deck 13, anchors 20 are mounted on the anchor rails 15. Each anchor 20 includes, for example, an eyebolt B, an upper nut N1, and a lower nut N2. The anchor 20 is not limited to this type of anchor and may be of another type (the anchor 20 may be, for example, a set of a hexagon head bolt, an upper nut, and a lower nut). The anchor 20 is slidably inserted into the anchor rail 15 through the rear end opening 54.

Specifically, the shaft portion of the eyebolt B is passed through the slit SL of the anchor rail 15 to place the upper nut N1 above the receiving plate 53 of the anchor rail 15 and place the lower nut N2 in a space (anchor space S1) lying below the receiving plate 53 of the anchor rail 15. The anchor 20 can be moved along the slit SL with the receiving plate 53 being not held tightly between the upper and lower nuts N1 and N2.

Once the user moves the anchor 20 to a desired position along the slit SL and rotates the eyebolt B or upper nut N1, the upper and lower nuts N1 and N2 hold the receiving plate 53 tightly therebetween, and the anchor 20 is fastened to the anchor rail 15. The user hooks an end of a stretch wire W to the eyebolt B. The stretch wire W is for holding the cargo Y placed on the cargo-carrying surface 43*a*. The use of the anchor rail 15 is not limited to this example, and a cargo-holding platform may be secured to the anchor rail 15 using an anchor (such as a set of a hexagon head bolt, an upper nut, and a lower nut).

In the configuration described above, the anchor 20 can be placed in a position desired by the user in the longitudinal direction of the anchor rail 15. This increases the variety of sizes, shapes, and placement positions of cargoes Y placeable on the cargo-carrying surface 43*a*, thus providing improved user-friendliness.

Since the anchor rail 15 does not project upward beyond the cargo-carrying surface 43*a*, the anchor rail 15 does not interfere with a cargo Y placed on the cargo-carrying surface 43*a* even when a part of the cargo Y is located directly above the anchor rail 15. Thus, the variety of placement positions of the cargo Y is further increased, and the user-friendliness is further improved. Additionally, the anchor rail 15 does not impede the user when any cargo Y is not placed on the cargo-carrying surface 43*a*. Thus, the user can comfortably use the cargo-carrying surface 43*a* located rearward of the seat support 31 for multiple purposes.

The two anchor rails 15 extend in the front-rear direction and are spaced apart from each other in the left-right direction. As such, the positions of the two anchors 20 positioned respectively on the two anchor rails 15 can be continuously adjusted on the anchor rails 15 while the midpoint between the two anchors 20 is kept at or around the center of the watercraft body 2 in the left-right direction.

The outer edge surfaces 43*ab* of the cargo-carrying surface 43*a*, which are located outward of the anchor rails 15 in the left-right direction, are inclined downward toward the anchor rails 15. As such, when the cargo-carrying surface 43*a* is exposed to water, the water can be gathered into the anchor rails 15 and directed out of the watercraft through the anchor rails 15.

The anchor rails 15 are inclined to extend rearward and downward when the PWC 1 is at rest on the water. As such, water entering the anchor rails 15 can be spontaneously discharged rearward from the anchor rails 15. Further, since the rear ends of the anchor rails 15 are located forward of the rear ends of the receiving grooves 41*b* and buried in the watercraft body 2, the anchor rails 15 can be prevented from impeding the user.

Although each receiving groove 41*b* has a recessed region where the anchor rail 15 is not placed, this region can be filled with the filler 18. The filler 18 can also cover the rear end of the anchor rail 15. If the anchor 20 is loosened and moved along the anchor rail 15, the filler 18 can prevent the components of the anchor 20 from falling off the watercraft body 2. The filler 18 is removable to uncover the rear end opening 54 of the anchor rail 15, and the anchor 20 can easily be slidably mounted on the anchor rail 15 through the uncovered rear end opening 54.

Each anchor rail 15 includes the slit SL formed in the receiving plate 53 exposed to the environment outside the watercraft body 2, and the anchor 20 can be inserted into the slit SL of the anchor rail 15 and slid along the slit SL. Thus, the anchor 20 can easily be moved to a desired position and fastened to the receiving plate 53.

Each anchor rail 15 includes the reinforcing portion 60 which is located outward of the rail main portion 50 in the width direction of the slit SL and which defines a closed cross-section together with the rail main portion 50. The reinforcing portion 60 can prevent the rail main portion 50 from being deformed to such a degree that the width of the slit SL is changed. Thus, the anchor rail 15 can exhibit increased rigidity. Since the upper fastener 16 secures the reinforcing portion 60 to the watercraft body 2, the reinforcing portion 60 of the anchor rail 15 contributes to both reinforcement of the anchor rail 15 and securing of the anchor rail 15 to the watercraft body 2. As such, efficient layout of the components can be achieved.

Each anchor rail 15 includes the collar 15*c* held between the head portion 16*b* of the upper fastener 16 and the bottom plate 61 of the reinforcing portion 60. Thus, the head portion 16*b* of the upper fastener 16 is located away from the bottom plate 61 of the reinforcing portion 60 and close to the upper surface of the anchor rail 15. As such, the head portion 16*b* of the upper fastener 16 is easily accessible from outside the watercraft body 2, and ease of maintenance is increased. The collar 15*c* has a length such that the upper surface of the head portion 16*b* of the upper fastener 16 does not project from the upper surface of the anchor rail 15 to the environment outside (above) the watercraft body 2. Thus, the upper fastener 16 can be prevented from impeding the user.

Since the additional deck 13 is removably secured to the base deck 12, the length of the region posterior to the seat support 31 can easily be extended rearward in the front-rear direction. That is, the cargo-carrying surface 43*a* can easily be widened without having to modify the hull 11 and the base deck 12. When the additional deck 13 is not required, the watercraft body can be used with the additional deck 13 removed.

The upper fasteners 16 fasten the anchor rails 15, the additional deck 13, and the base deck 12 together. That is, the upper fasteners 16 can provide both securing of the anchor rails 15 to the additional deck 13 and securing of the additional deck 13 to the base deck 12. This allows for efficient layout of the components. The side fasteners 14 fasten the additional deck 13, the base deck 12, and the hull 11 together at the rear portion of the gunwale line G. That is, the side fasteners 14 can provide both securing of the additional deck 13 to the base deck 12 and securing of the base deck 12 to the hull 11.

The additional deck 13 includes the upper and lower panels 41 and 42 by which the rear portion of the gunwale line G where the hull 11 and the base deck 12 are connected is covered from above and below. Such an additional deck 13 can easily be manufactured and mounted on the hull 11 and the base deck 12. The lower panel 42 includes the pair of gussets 42*b* which are located to the left and right, respectively, of the pump opening 24 and which are in contact with the back surface 23 of the hull 11. This simple design can increase the strength of the additional deck 13.

The partitions 41*c* projecting upward with respect to the cargo-carrying surface 43*a* and the foot rest surfaces 32 are located between the cargo-carrying surface 43*a* and the foot rest surfaces 32. Thus, if the cargo-carrying surface 43*a* is exposed to water during backward movement of the PWC 1, the partitions 41*c* block forward movement of the water. Consequently, the water can be prevented from reaching the foot rest surfaces 32.

Figure 10:
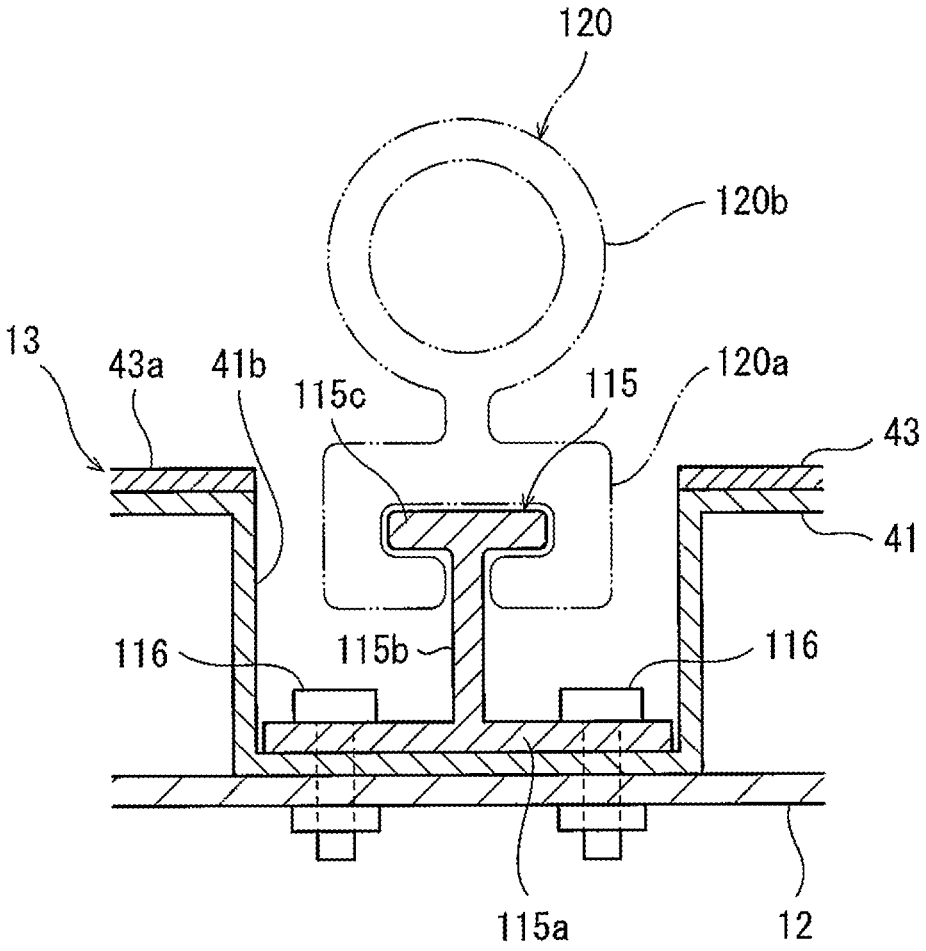
FIG. 10 is a cross-sectional view of an anchor rail and its vicinity in a personal watercraft according to a first variant.

FIG. 10 is a cross-sectional view of an anchor rail 115 and its vicinity in a PWC according to a first variant. As seen from FIG. 10, the anchor rail 115 of the first variant is I-shaped in cross-section. The anchor rail 115 includes a bottom plate 115*a*, a vertical plate 115*b*, and a retaining plate 115*c*. The bottom plate 115*a* is placed on the bottom surface of the receiving groove 41*b* of the upper panel 41 of the additional deck 13 and is secured to the upper panel 41 and the base deck 12 by upper fasteners 116. The vertical plate 115*b* projects upward from the center in the left-right direction of the bottom plate 115*a*. The retaining plate 115*c* is located above and away from the bottom plate 115*a*. The retaining plate 115*c* is positioned parallel to the bottom plate 115*a* and projects from the upper edge of the vertical plate 115*b* in the left-right direction. The length over which the retaining plate 115*c* projects from the vertical plate 115*b* in the left-right direction is smaller than the length over which the bottom plate 115*a* projects from the vertical plate 115*b* in the left-right direction. The upper surface of the retaining plate 115*c* is an outwardly facing surface exposed to the environment outside the watercraft body. A gap is formed between the retaining plate 115*c* and the cargo-carrying surface 43*a*.

An anchor 120 includes a slide portion 120*a* slidably fitted on the retaining plate 115*c*. The slide portion 120*a* is shaped to face the left, right, upper, and lower sides of the retaining plate 115*c*. The anchor 120 includes an attachment portion 120*b* continuous with the slide portion 120*a* and projecting upward from the slide portion 120*a*. The stretch wire W as shown in FIG. 9 can be hooked to the attachment portion 120*b*. The anchor 120 can thus be placed in a position desired by the user in the longitudinal direction of the anchor rail 115. The other elements of the first variant are the same as those of the embodiment described above and will not be described repeatedly.

Figure 11:
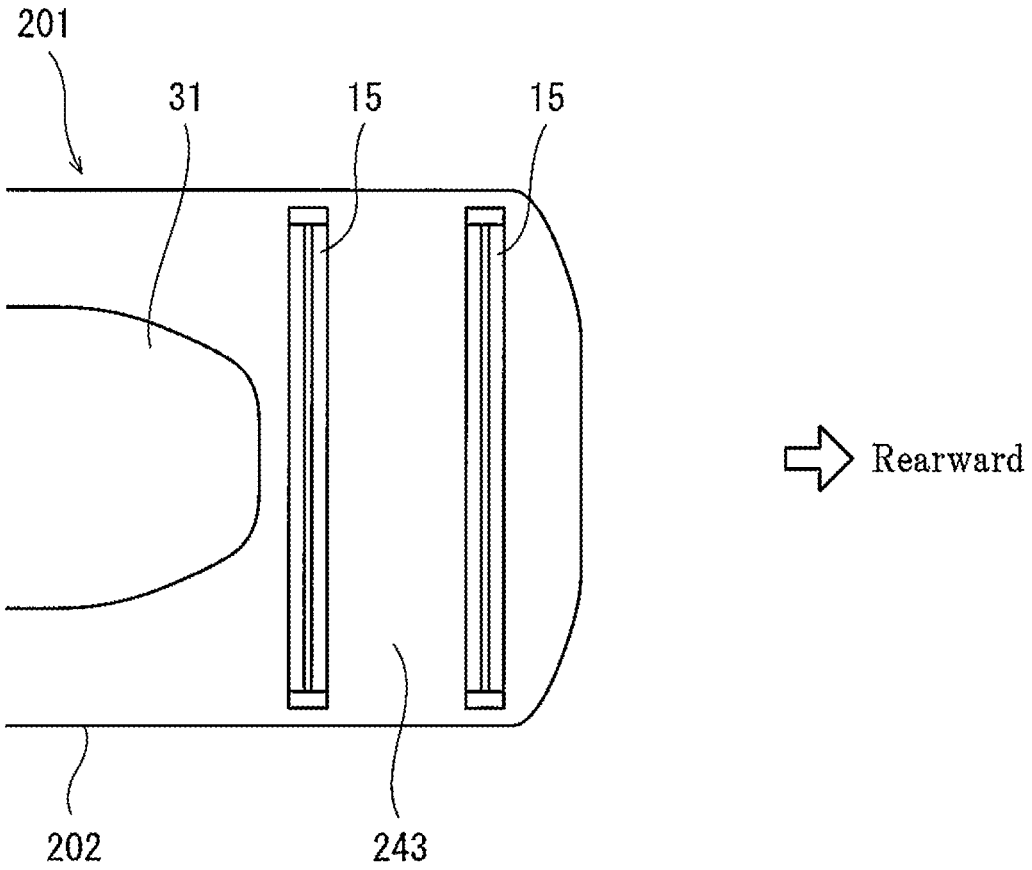
FIG. 11 is a plan view of the rear of a personal watercraft according to a second variant.

FIG. 11 is a plan view of the rear of a PWC 201 according to a second variant. As seen from FIG. 11, the rear of a watercraft body 202 of the PWC 201 includes a cargo-carrying surface 243 located rearward of the seat support 31. The pair of anchor rails 15 are disposed rearward of the seat support 31. The two anchor rails 15 extend in the left-right direction and are spaced apart from each other in the front-rear direction. The anchor rails 15 are mounted on the watercraft body 202 in such a manner that they are adjacent to the cargo-carrying surface 243 and exposed to the environment outside (above) the watercraft body 202. This allows for easy adjustment of the position of a cargo on the cargo-carrying surface 243 in the left-right direction. The other elements of the second variant are the same as those of the embodiment described above and will not be described repeatedly.

Many modifications and other embodiments of the present invention will be apparent to those skilled in the art from the foregoing description. Accordingly, the foregoing description is to be construed as illustrative only, and is provided for the purpose of teaching those skilled in the art the best mode for carrying out the invention. The details of the structure and/or function may be varied substantially without departing from the scope of the invention.

For example, the cargo-carrying surface need not be located rearward of the rear seat 9, and may be located forward of the rear end of the rear seat 9. The additional deck 13 need not include the covering sheet 43, and the upper surface 41*a* of the upper panel 41 may be used as the cargo-carrying surface. The additional deck 13 need not be an assembly of the upper and lower panels 41 and 42, and may be formed by one-piece molding. The anchor rails 15 may be secured to the base deck 12 without mounting the additional deck 13. The number of the anchor rails 15 is not limited to two, and one anchor rail 15 or three or more anchor rails 15 may be used. The anchor rails 15 may be non-parallel to one another.

What is claimed is:

1. A personal watercraft comprising:

a watercraft body comprising a cargo-carrying surface; and at least one anchor rail mounted on the watercraft body, the at least one anchor rail being adjacent to the cargo-carrying surface and exposed to an environment outside the watercraft body, wherein the at least one anchor rail comprises an outwardly facing surface exposed to the environment outside the watercraft body, and the at least one anchor rail is secured to the watercraft body in such a manner that the outwardly facing surface is recessed relative to the cargo-carrying surface to form a recess or that the outwardly facing surface is flush with the cargo-carrying surface.

2. The personal watercraft according to claim 1, further comprising a seat on which a user sits, wherein the watercraft body further comprises a seat support supporting the seat, the cargo-carrying surface is located rearward of the seat and faces upward, and the at least one anchor rail mounted on the watercraft body is located rearward of the seat.

3. The personal watercraft according to claim 1, wherein the cargo-carrying surface faces upward, the recess is a downward recess, and the cargo-carrying surface comprises a region located outward of the at least one anchor rail in a left-right direction and inclined downward toward the at least one anchor rail.

4. The personal watercraft according to claim 1, wherein the at least one anchor rail includes a pair of anchor rails extending in a front-rear direction and spaced apart from each other in a left-right direction.

5. A personal watercraft comprising:

a watercraft body comprising a cargo-carrying surface; and at least one anchor rail mounted on the watercraft body, the at least one anchor rail being adjacent to the cargo-carrying surface and exposed to an environment outside the watercraft body, wherein the at least one anchor rail includes a pair of anchor rails extending in a front-rear direction and spaced apart from each other in a left-right direction, and each anchor rail is inclined to extend rearward and downward when the personal watercraft is at rest on water.

6. The personal watercraft according to claim 1, wherein the at least one anchor rail includes a pair of anchor rails extending in a left-right direction and spaced apart from each other in a front-rear direction.

7. A personal watercraft comprising:

a watercraft body comprising a cargo-carrying surface; and at least one anchor rail mounted on the watercraft body, the at least one anchor rail being adjacent to the cargo-carrying surface and exposed to an environment outside the watercraft body, wherein the watercraft body comprises a receiving groove in which the at least one anchor rail is placed, a longitudinal length of the receiving groove is greater than a longitudinal length of the at least one anchor rail, and a longitudinal end of the at least one anchor rail is located closer to a center of the watercraft body than a longitudinal end of the receiving groove in a direction along the longitudinal length of the receiving groove.

8. The personal watercraft according to claim 7, further comprising a filler placed in the receiving groove and covering the longitudinal end of the at least one anchor rail, wherein the filler is removably secured to the watercraft body.

9. The personal watercraft according to claim 1, wherein the at least one anchor rail comprises: a receiving plate exposed to the environment outside the watercraft body; and a slit formed in the receiving plate and extending in a longitudinal direction of the at least one anchor rail.

10. The personal watercraft according to claim 9, wherein the at least one anchor rail comprises: a rail main portion comprising the receiving plate and the slit and defining an anchor space, the anchor space communicating with the environment outside the watercraft body through the slit and extending in the longitudinal direction of the at least one anchor rail; and a reinforcing portion located outward of the rail main portion in a width direction of the slit and connected to a side surface of the rail main portion, the reinforcing portion forming a closed cross-section together with the rail main portion.

11. The personal watercraft according to claim 10, further comprising a fastener securing the at least one anchor rail to the watercraft body, wherein the fastener secures the reinforcing portion to the watercraft body.

12. The personal watercraft according to claim 11, wherein the reinforcing portion comprises a bottom plate in contact with the watercraft body and the outwardly facing surface lying side-by-side with the slit and exposed to the environment outside the watercraft body, the fastener comprises a shaft portion and a head portion located at an end of the shaft portion, and the at least one anchor rail further comprises a collar held between the head portion of the fastener and the bottom plate of the reinforcing portion.

13. The personal watercraft according to claim 12, wherein the collar has a length such that a surface of the head portion of the fastener does not project from the outwardly facing surface to the environment outside the watercraft body.

14. The personal watercraft according to claim 2, wherein the watercraft body comprises:

a hull comprising a back surface provided with a pump opening through which a water jet pump is exposed to an environment behind the watercraft body;

a base deck covering the hull from above and secured to the hull, the base deck comprising the seat support and a rear deck surface located rearward of the seat, the rear deck surface facing upward; and an additional deck comprising the cargo-carrying surface and secured to the base deck to cover the rear deck surface, the at least one anchor rail is mounted on the additional deck, and the additional deck comprises a projecting portion extending rearward beyond the hull and the base deck.

15. The personal watercraft according to claim 14, further comprising an upper fastener, wherein the additional deck comprises a receiving groove in which the at least one anchor rail is placed from above, a lower surface of a bottom wall of the receiving groove is in contact with the rear deck surface of the base deck, a lower surface of the at least one anchor rail is in contact with an upper surface of the bottom wall of the receiving groove, and the upper fastener fastens the at least one anchor rail, the additional deck, and the base deck together at the bottom wall of the receiving groove.

16. The personal watercraft according to claim 14, further comprising a side fastener, wherein the additional deck covers a rear portion of a gunwale line where the hull and the base deck are connected, and the side fastener fastens the additional deck, the base deck, and the hull together at the rear portion of the gunwale line.

17. The personal watercraft according to claim 14, wherein the additional deck comprises:

an upper panel covering the rear deck surface of the base deck from above and having a projecting portion extending rearward beyond the back surface of the hull; and a lower panel covering the projecting portion of the upper panel from below and secured to the upper panel, and the upper and lower panels cover a rear portion of a gunwale line from above and below, respectively, the gunwale line being where the hull and the base deck are connected.

18. The personal watercraft according to claim 17, wherein the lower panel comprises a lower surface located above the pump opening and a pair of gussets projecting downward from the lower surface of the lower panel, and the gussets are located to the left and right, respectively, of the pump opening and are in contact with the back surface of the hull.

19. The personal watercraft according to claim 2, wherein the watercraft body comprises: a pair of foot rest surfaces located to the left and right, respectively, of the seat support and extending in a front-rear direction; and a partition located between the cargo-carrying surface and the pair of foot rest surfaces and projecting upward with respect to the cargo-carrying surface and the foot rest surfaces.

* * * * *